United States Patent [19]

Moulin

[11] 4,067,790

[45] Jan. 10, 1978

[54] METHOD OF ELECTROLYTICALLY MARKING METALLIC ARTICLES

[75] Inventor: Guy Moulin, Velizy-Villacoublay, France

[73] Assignee: SKF Compagnie d'Applications Mecaniques, Clamart, France

[21] Appl. No.: 740,065

[22] Filed: Nov. 8, 1976

[30] Foreign Application Priority Data

Dec. 12, 1975 France ..... 75.37951

[51] Int. Cl.[2] ..... C25F 3/00; C25F 7/00

[52] U.S. Cl. ..... 204/129.6; 204/129.65; 204/140; 204/224 R; 204/278

[58] Field of Search ..... 204/129.43, 129.6, 224 R, 204/129.65, 140, 278

[56] References Cited

U.S. PATENT DOCUMENTS 3,748,239 7/1973 De Lavalette ..... 204/129.4

3,907,649 9/1975 Becker ..... 204/224 R X

FOREIGN PATENT DOCUMENTS 1,360,811 4/1963 France ..... 204/224 R

*Primary Examiner*—John H. Mack
*Assistant Examiner*—D. R. Valentine
*Attorney, Agent, or Firm*—Brisebois & Kruger

[57] ABSTRACT

In a known method of electrolytically marking metallic articles a hood having its bottom closed by a stencil with perforations is partially filled with an electrolyte and contains a cathode. An article to be marked is brought into contact with the stencil and constitutes the anode. The invention consists in maintaining the space within the hood at a partial vacuum sufficient to cause bubbles of air which have passed through the perforations in the stencil to flow upward in the hood, thus preventing electrolyte from seeping downward through said perforations.

7 Claims, 1 Drawing Figure

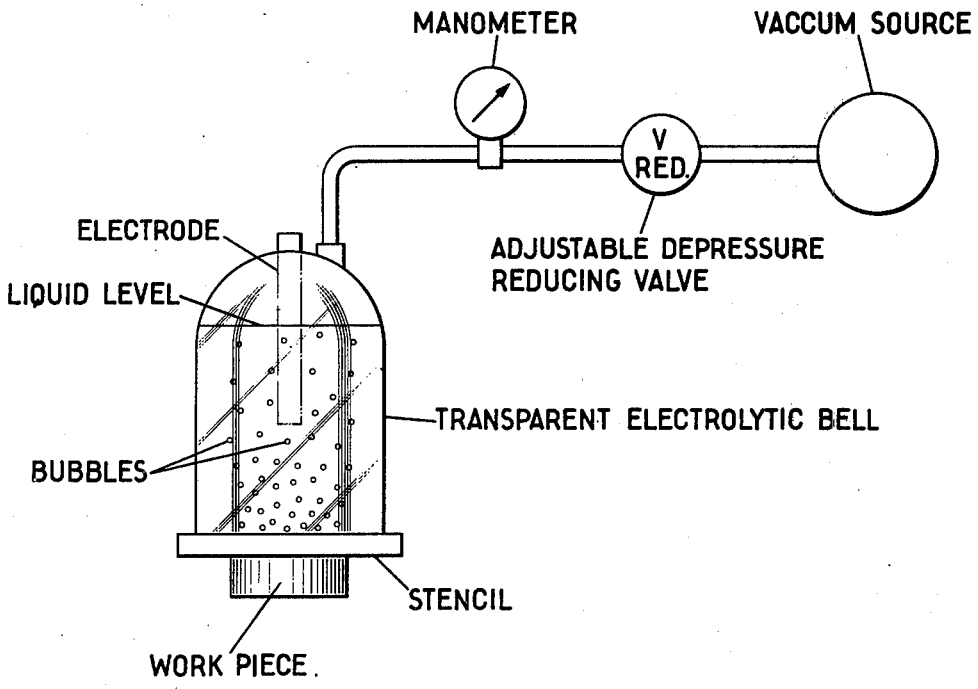
MANOMETER
VACCUM SOURCE
V
RED.
ADJUSTABLE DEPRESSURE
REDUCING VALVE
ELECTRODE
LIQUID LEVEL
TRANSPARENT ELECTROLYTIC BELL
BUBBLES
STENCIL
WORK PIECE.

METHOD OF ELECTROLYTICALLY MARKING METALLIC ARTICLES

SUMMARY OF THE INVENTION

This invention relates to an improvement in a process for electrolytically marking metallic articles of the type described in U.S. Pat. No. 3,748,239.

That patent describes an electrolytic marking method which is particularly valuable for the rapid marking of very numerous metallic article and consists in improving the clarity and depth of marking produced within a very short allowed time by preceding the period of direct current electrolysis by a flash of alternating current several tenths of a second long which insures the cleansing of the article.

This process is carried out by means of a known marking device which utilizes a hood covering the cathode and the electrolyte, the lower opening of which is closed by means of a stencil which is rendered porous in a conventional manner along the lines of the mark to be applied. The article to be marked, which constitutes the anode, is positioned beneath the hood against the stencil before starting the working cycle.

In commercial practice, when this process is carried out repeatedly, it is found that the lower portion of the stencil produces a progressive fouling thereof so that the lines are progressively dulled and lose their clarity. It is therefore necessary to remove and clean the stencil each 15,000 marks. Moreover, these manipulations lead to the rapid destruction of the stencil which in practice cannot be subjected to more than three washings and consequently must be replaced after about 60,000 marks have been applied.

The purpose of the invention is to eliminate these disadvantages, that is to say, to increase the longevity of the stencil and increase the clarity of the mark produced thereby.

The invention consists in placing the electrolytic hood under a partial vacuum as compared wth atmospheric pressure while connecting the upper part thereof which is situated above the level of the electrolyte to a source of vacuum through an adjustable pressure reducing valve. The hood is, moreover, made of a transparent material and the pressure reducing valve is so regulated as to cause a regular release of bubbles through the stencil toward the inside of the hood, which corresponds to a relatively slight pressure difference between the two surfaces of the stencil, the vacuum at the level of the pressure reducing valve being consequently greater than the difference in hydrostatic pressure corresponding to the height of the level of the electrolyte in the hood above the stencil.

By way of example, the stencil used may be made of a product sold under the trademark "TERPHANE" in which the small holes which form the line of the letters of the mark are punched by a stylus manipulated by a pantograph.

The electrolyte used may be, as indicated in U.S. Pat. No. 3,748,239, the product sold under the trademark "PRINTOLIN", having a sodium nitrate base which is more or less diluted in water. During the passage of the electric current the electrolyte oxidizes the edges of the holes which are no longer clearly marked. This results in a local blurring of the line in the form of rough edges. Independently of this, the lower position of the stencil predisposes it to receive any deposits which are produced in the electrolysis tank. These have a tendency to progressively block the lines of holes in the stencil up to the point of producing omissions. This results in a necessity for periodic cleanings which lead to the progressive destruction of the stencil as described above.

In accordance with the invention this problem is overcome by maintaining the electrolytic hood under vacuum. The vacuum source may be a vacuum pump, a pump having vanes, a water suction pump, or simply an air pump connected to a source of compressed air which produces a partial vacuum equal to a fraction of an atmosphere. This vacuum source supplies a pressure-reducing valve which may be adjusted, for example, within the range of 15–25 millibars. The vacuum thus regulated by the pressure-reducing valve is then applied through a duct to the top of the electrolysis hood above the normal level of the electrolyte in order to avoid aspiration thereof. This hood is preferably made of a transparent material in order to permit the observation of the level of the electrolyte, and its replenishment if necessary, and also to permit observation of the formation of bubbles as set forth above. If it be supposed, in order to simplify the reasoning, that the density of the electrolyte is approximately the density of water and that consequently the variation in the hydrostatic pressure of the electrolyte is approximately 1 millibar per centimeter, it is clear that if atmospheric pressure is established at the top of the hood, at the level of the upper surface of the stencil, there will be a pressure corresponding to the height of the liquid level in the hood, generally 10 to 15 centimeters. This pressure forces the liquid to pass through the holes in the stencil and is counterbalanced only by the small forces of capillarity. This results in an important loss of electrolyte which abundantly moistens each of the articles marked, and the stencil clogs up rapidly as a consequence of the deposits which are produced. If the lower part of the hood is not open to the atmosphere, but closed, as a slight vacuum is automatically produced due to the flow of liquid, but this is in general insufficient in itself.

A preferred embodiment of my proposed solution to this problem is illustrated in the accompanying drawing.

By connecting the upper part of the hood to the vacuum source through the pressure reducing valve, which is regulated as explained above, it is possible to adjust the pressure which prevails above the liquid level to a progressively increasing negative value by adjustment of the pressure regulating valve. It is then found that when this vacuum reaches a valve sufficient to correspond to the hydrostatic pressue due to the height of the liquid above the stencil, after allowing a small adjustment to allow for capillarity, bubbles of air begin to be released, at first irregularly and then if the vacuum increases, sufficient to form a continuous curtain of bubbles, before there is a true boiling of bubbles.

When a continuous curtain of bubbles is formed, which corresponds to the adjustment according to the invention, the passage of air through the stencil produces permanent self-cleaning thereof and at the same time a continuous return to suspension of the deposits which have had a tendency to be produced. If the release of the bubbles is irregular and insufficient, only a small improvemet results. If, on the contrary, the release of bubbles is excessive, the electrolyte no longer reaches the article to be marked so that, in the very short time allowed, the marking is inadequate. The two extreme values are not, however, very critical, and it is easy to find the optimum adjustment of the pressure regulating valve by cut and try and simple observation of the curtain of bubbles which is released from the lines of the stencil. Once this adjustment has been made, the valve maintains the vacuum at a constant pressure, and since the height of the liquid level in the hood varies very slowly, and even more slowly because the vacuum reduces the consumption of electrolyte, it is not generally necessary to periodically change the adjustment.

As a consequence of this improvement, a new stencil may easily make 100,000 marks without any removal or intermediate cleaning, after which it is directly replaced by a new stencil.

In addition to this very clear improvemet in the longevity of the stencil, a very clear improvement in the quality of the marking and a very small variation in this quality has been observed. In effect, because of the permanent self-cleaning of the stencil, the edges of the letters remain clear and sharp and the shape of the letters remains regular without roughness, blurring of the line, or blank spots.

What is claimed is:

1. A method of electrolytically marking metallic articles comprising, the steps of, providing a chamber containing an electrolyte at a normal level therein and having a stencil closing its bottom, the stencil having a porous portion corresponding to the design to be marked on an article, creating a partial vacuum in the chamber in the region above the normal level of the electrolyte with a vacuum device, placing the article to be marked below and in engagement with the stencil, and applying an electric current between the electrolyte and the article.

2. A method of electrolytically marking metallic articles according to claim 1 wherein said step of providing a chamber comprises providing a chamber of transparent material, and said step of creating a partial vacuum comprises controlling the vacuum with a pressure reducing valve adjusted to provide a regular flow of air bubbles passing inwardly through the marking stencil.

3. A method of electrolytically marking metallic articles according to claim 2 wherein the pressure reducing valve is adjusted to produce a reduction in pressure, relative to the ambient atmosphere, of between 15 and 25 millibars.

4. A method according to claim 1 wherein said step of creating a partial vacuum in the chamber further comprises creating a vacuum sufficient to cause a slight inflow of air into the chamber through the porous portion of said stencil.

5. A method according to claim 1 wherein said step of creating a partial vacuum in the chamber comprises creating a vacuum sufficient to prevent the flow of electrolyte outwardly through the porous portion of the stencil.

6. A method of increasing the life of a stencil and maintaining the clarity of its electrolytic marking on a metallic article, the stencil being of the type having a porous portion corresponding to the design to be marked electrolytically on the article and located at the bottom of a chamber containing an electrolyte, comprising creating a differential pressure across the porous portion of the stencil, engaging the stencil against the article to be marked, and applying an electric current between the electrolyte and the article, said differential pressure being sufficient to cause an inward flow of air through the porous portion of the stencil and into the chamber at a rate sufficient to prevent fouling of the porous portion and thus substantially eliminate the need for separate cleaning of the stencil.

7. A method according to claim 6 wherein said step of creating said differential pressure comprises, creating a partial vacuum in an upper portion of the chamber, above the normal level of electrolyte in the chamber.

* * * * *